United States Patent [19]

Latimer

[11] 4,249,324

[45] * Feb. 10, 1981

[54] STEERABLE OCEAN FLOOR DREDGE VEHICLE

[75] Inventor: John P. Latimer, Newport News, Va.

[73] Assignee: Deepsea Ventures, Inc., Gloucester Point, Va.

[ * ] Notice: The portion of the term of this patent subsequent to Feb. 24, 1997, has been disclaimed.

[21] Appl. No.: 33,333

[22] Filed: Apr. 25, 1979

Related U.S. Application Data

[63] Continuation-in-part of Ser. No. 910,080, May 26, 1978, Pat. No. 4,208,813.

[51] Int. Cl.[3] ..... E02F 3/88

[52] U.S. Cl. ..... 37/58; 37/72; 37/DIG. 8; 114/246; 280/487

[58] Field of Search ..... 37/57, 58, 54, DIG. 8, 37/72; 114/246; 280/486, 487

[56] References Cited

U.S. PATENT DOCUMENTS

| | | | |
|---|---|---|---|
| 3,484,843 | 12/1969 | Martin | 37/126 R |
| 3,588,174 | 6/1971 | Rossfelder et al. | 37/DIG. 8 |
| 3,645,225 | 2/1972 | Lunde | 114/246 |
| 4,026,049 | 5/1977 | Johnson | 37/72 X |
| 4,029,307 | 6/1977 | Nielson | 280/487 X |

*Primary Examiner*—Clifford D. Crowder
*Attorney, Agent, or Firm*—Barry G. Magidoff

[57] ABSTRACT

A steerable ocean floor dredge vehicle is provided which is of the towed variety, or partially self-propelled. The vehicle is towed from a surface ship via a rigid length of pipe or tubing, connected to the dredge vehicle via a pivoting joint permitting pivotal movement about two transverse axes and preferably about a third axis, and a telescoping joint for providing movement along the direction of the axis of the towing line. Pivoting means connect from the sides of the dredge vehicle to the towing pipe at a point between the telescopic joint and the surface. The pivoting means comprise two flexible cables extending about rollers on the dredge vehicle, or hydraulic piston and cylinder combinations. In operation, pulling one cable, or pushing on one piston, causes the dredge vehicle to be skewed in a first angular direction relative to the towing pipe; pulling or pushing, respectively, in the opposite direction causes the dredge vehicle to be skewed about in an opposite angular direction relative to the towing pipe, thereby permitting at least a limited movement of the dredge vehicle along the ocean floor in directions transverse to the towing pipe.

10 Claims, 7 Drawing Figures

STEERABLE OCEAN FLOOR DREDGE VEHICLE

This is a continuation in part of co-pending application Ser. No. 910,080, filed May 26, 1978, and now U.S. Pat. No. 4,208,813.

This invention provides a remotely steerable dredge head vehicle, and the like, which is moved by towing means connected to a surface vessel, along the bottom of the sea.

With the coming shortage of land-based high grade metal ores, miners are turning to new sources of such metals, including especially the bottom of the sea. It has been known for almost a century now that small, generally fist-sized particles of relatively high grade manganese ore, containing in addition valuable quantities of nickel, copper, cobalt and other metals, can be readily obtained by simply dredging the bottom of the ocean. However, the major problems of reaching the depths at which such nodule ores are found in sufficient concentration to be economic, and the problems of refining these ores, have prevented, up to now, the commercial exploitation of this resource.

The art has developed a variety of means for removing these ores from the floor of the oceans and bringing them to the surface, from which they can be refined into the desired valuable metals. Generally, these ores cannot be obtained in commercial quantities at ocean floor depths much above 12,000 feet. It is anticipated that most future mining of the seas will take place at depths of between 12,000 and 20,000 feet beneath the surface of the ocean. Thus, the difficulties of obtaining these ores have been a major problem in preventing their commercial exploitation. Most of the anticipated means for reaching the ocean floor include a device, such as a dredge head, intended to move along the floor of the ocean, towed by a surface vessel. Such devices can move along the ocean floor on skids, or runners, or can move on wheels or lug treads. Such devices include self-propelled devices, wholly passive devices whose motive force is conveyed from the surface of the ocean via a cable or a rigid tubular member, such as a pipe. The rigid pipe can also serve as a means for transporting the collected ores from the dredge head up to the surface, as by an airlift system.

In the towed type of dredge vehicle, regardless of the supporting means between the vehicle and the ocean floor, the main steering means is provided by the connection between the surface vessel and the dredge, which provides the towing force to the dredge. The problems of steering the dredge over the ocean floor is compounded by the extreme length of such a tow line, in that the avoidance of relatively small obstacles on the ocean floor can require a major change in direction of the towing surface vehicle. Those dredge vehicles which are primarily self-propelled, i.e., such as the wheeled vehicle disclosed by U.S. Pat. No. 3,504,943, have articulated members, or means for changing the relative speed of rotation of the wheels or treads on either side of the dredge vehicle, to provide the desired steering. However, the problem remains that the towed vehicles are the simplest vehicles to operate and, therefore, the cheapest to construct and maintain, with the least complications and thus smallest chance of becoming disabled. However, steering these towed dredge vehicles has remained a substantial problem preventing, or severely limiting, the commercial use of such towed vehicles for exploiting the ores on the ocean bottom.

In accordance with the present invention, there is now provided a towed dredge vehicle, which can be remotely steered from the surface towing vessel, without requiring any change in direction of the surface vessel, in order to avoid relatively small obstacles on the ocean floor, by pivoting the dredge vehicle in the plane of the ocean floor relative to the towing vessel. The steerable dredge vehicle includes relatively rigid lower towing connector means, secured to the dredge vehicle; an upper towing connector means pivotally connected to the lower towing connector means; and a pivotable joint secured between the upper and lower towing connector means, the joint permitting relative pivotal movement between the upper and lower connecting means about at least two axes transverse to each other and to the longitudinal axis of the towing connector means; towing means connected to the upper towing connector; a telescopic joint between the towing means and the dredge vehicle which permits relative linear movement between the towing means and the lower connector means along a direction parallel to the longitudinal axis of the towing means; linkage means between the relatively rigid towing means and the dredge vehicle; means for moving the linkage means relative to the dredge vehicle so as to cause pivotal motion of the dredge vehicle relative to the towing means and upper towing connector means in a first angular direction by movement of the linkage means in a first linear direction, and causing an opposite pivotal movement between the towing means and the dredge vehicle in a second angular direction by movement of the linkage means in a second opposing linear direction.

The invention defined herein is exemplified by the embodiments described hereinbelow and depicted in the accompanying drawings. These preferred embodiments are presented herein to provide a more clear understanding of the invention and its advantages.

Figure 1:
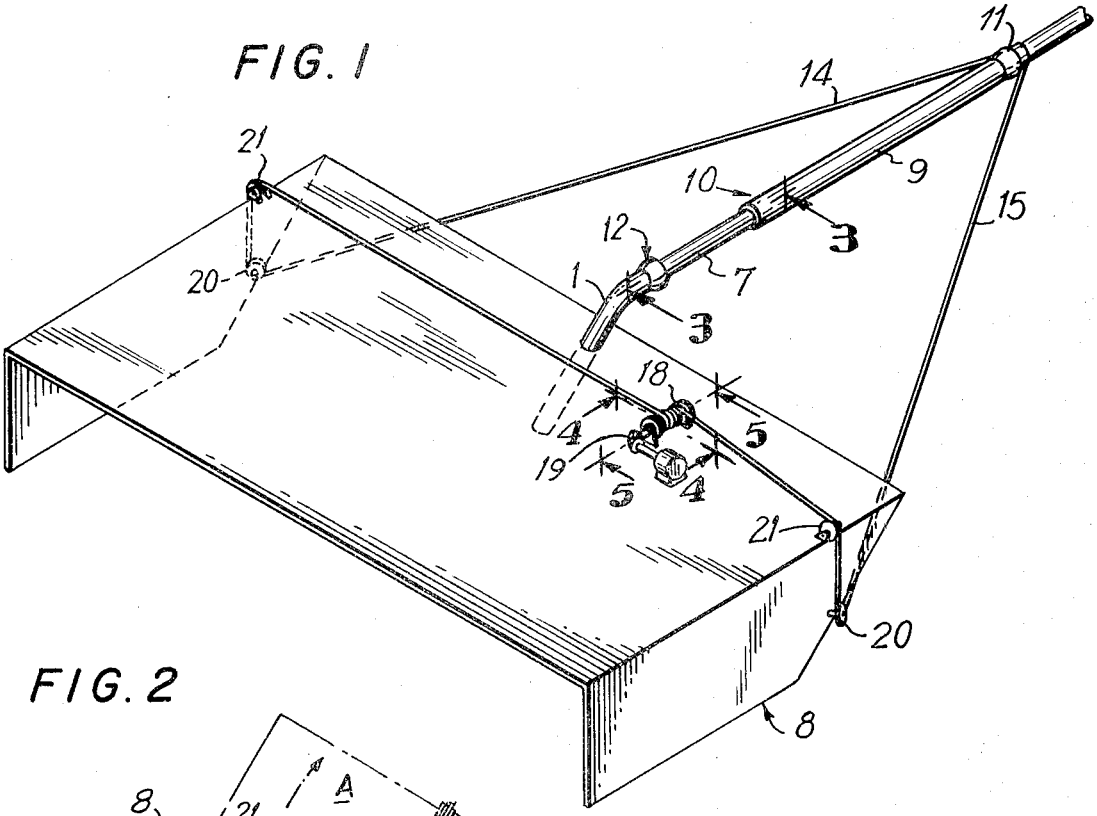
FIG. 1 is an overall isometric sketch depicting the concept of the present invention.
Figure 2:
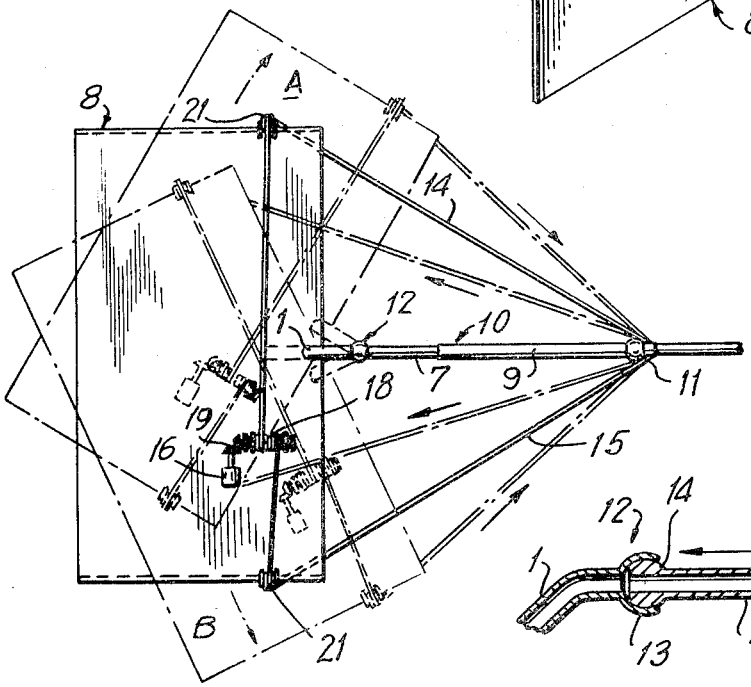
FIG. 2 is a plan view showing the various positions of the dredge vehicle by phantom lines.
Figure 3:
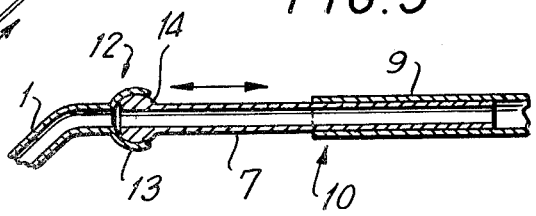
FIG. 3 is a partial cross-section taken along lines 3—3 of FIG. 1.
Figure 4:
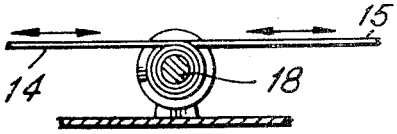
FIG. 4 is a partial cross-section taken along lines 4—4 of FIG. 1.
Figure 5:
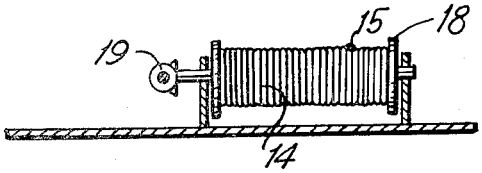
FIG. 5 is a view taken along lines 5—5 of FIG. 1.

In FIGS. 1–5, a dredge vehicle, generally indicated by the numeral 8, is of the sled or skid runner type. The dredge vehicle 8 is, in this embodiment, rigidly connected to a lower connecting tow member 1, which is a relatively rigid length of bent pipe rigidly secured to the dredge vehicle 8, substantially at the forward edge of its upper portion. The lower connector pipe 1 is rigidly secured at its upper end to a portion of a universal joint, generally designated by the numeral 12. The lower connector pipe 1 is rigidly secured, in this case welded to form a single unit, to the concave hollowed-out portion 13 of the universal joint 12. A convex, generally ball-shaped member 14, is rotatably held within the concave portion 13 and rigidly secured, as by welding to form a single unit, to the upper tow pipe connector piece 7. The upper connector member 7 is in turn telescopically connected to the lower tow pipe section 9 via a telescoping joint generally designated by the numeral 10. The upper tow line connector 7 reciprocally fits within the lower portion of the tow line 9. A knuckle joint 11 is rigidly connected to the tow pipe 9 and has pinned thereto the ends of the steering cables 14, 15.

The flexible steering cables, 14, 15 each extend from the knuckle 11, transverse to the tow pipe 9, to a lower roller 20 secured to each side of the dredge vehicle 8, then to a pair of upper rollers 21, secured to the upper edge of the dredge vehicle 8, and then to the steering winch 18. The steering cables 14, 15 are wrapped about the winch 18. The cables 14, 15 can be a single length of cable wrapped about the winch 18 in a way to prevent slippage, or two lengths of cable, the ends of each being pinned to the barrel of the winch 18. The winch 18 is operated by the electrically operated hydraulic servo motor 16 which is connected to the winch 18 via the winch drive shaft 19.

Figure 6:
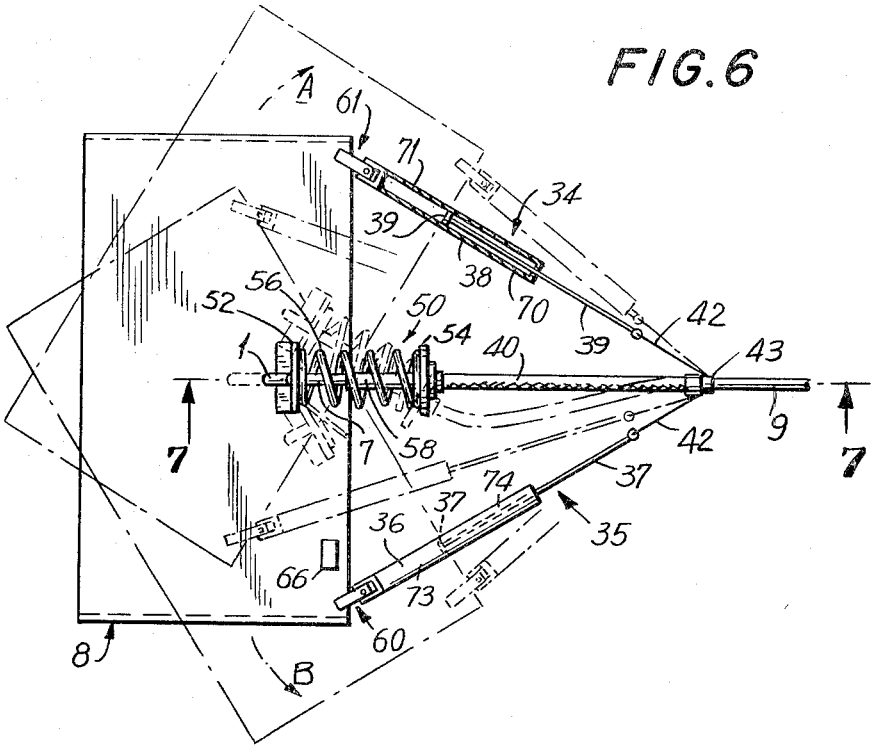
FIG. 6 is a plan view of a more preferred embodiment of the present invention.
Figure 7:
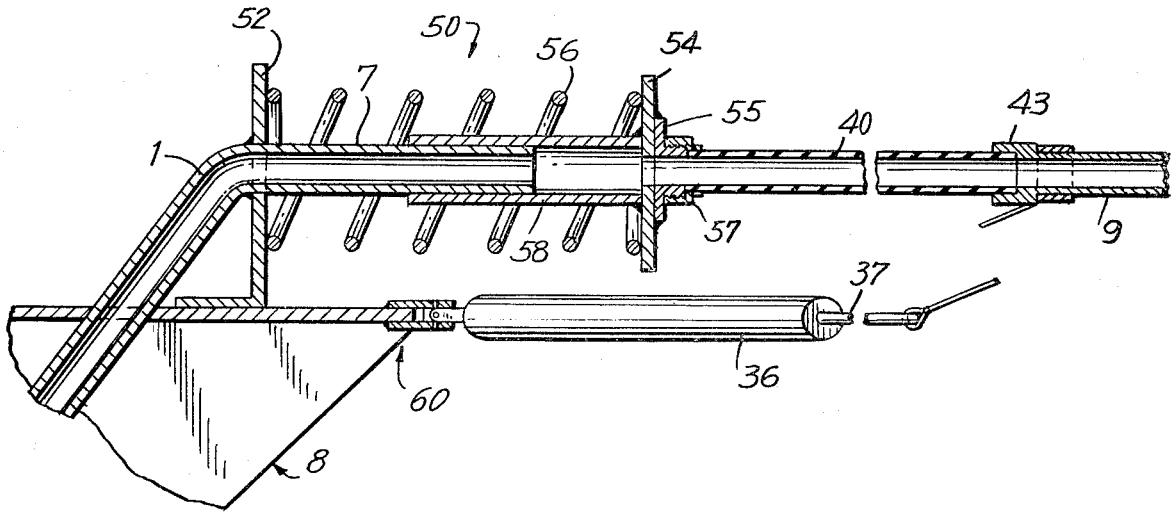
FIG. 7 is a partial cross-section taken along lines 7—7 of FIG. 6.

In the more preferred embodiment of FIGS. 6 and 7, vehicle 8 is also rigidly connected to a lower connecting tow member 1, which is a relatively rigid length of bent pipe rigidly secured to the dredge vehicle 8, substantially at the forward edge of its upper portion, and to angle member 52, (welded to the vehicle 8), at an upper portion thereof.

The upper end of the lower connector pipe 1 is in turn telescopically connected to an upper tow pipe connector member 58 via a biased telescoping joint, generally designated by the numeral 50. The lower tow pipe connector 1 reciprocally fits within one end of the upper tow pipe connector 58. A flange 54 is welded to the second end of the upper tow connector 58 and includes a threaded male member 55. A coiled spring 56, extends between and is welded to the angle member 52 and the flange 54, so as to bias the telescopic joint towards the intermediate position shown in FIG. 7.

A flexible hose portion 40 is threadedly coupled to the male member 55 at one end and to the tow pipe at the second end, via a tow coupling knuckle 43. A pair of short flexible cables 42 are each pinned at one end to the tow coupling 43. A pair of hydraulic devices, generally indicated by the numerals 34, 35, each extend transversely to the tow line connectors 40, 58, 1, between the cable 42 and each side of the dredge vehicle 8. Each hydraulic device 34, 35, comprises a hydraulic piston and piston rod 37, 39, reciprocatingly mounted within a hydraulic cylinder 36, 38. In the embodiment shown, the end of each hydraulic cylinder is pivotally attached through a pivotable joint 60, 61 to each forward corner of the dredge vehicle 8. Each hydraulic cylinder 36, 38 is in fluid pressure connection with an electrically powered hydraulic pump 66 through fluid pressure couplings, not shown. The hydraulic pump and the couplings are conventional and form no part of this invention. However, in the preferred embodiment the pressure connections are so arranged that pressure can be applied to either side of each piston 37, 39, by the opening and closing of valves (also not shown) between the pump 66 and the cylinders 36, 38 in accordance with conventional procedures.

For example, the valves between hydraulic pressure source 66 and the two cylinders 36, 38 can be arranged to provide the following effects:

1. In a first valve position, pressure is applied to the far chamber 70 of cylinder 38 and to the near chamber 73 of cylinder 36, while the near chamber 71 of cylinder 38 and the far chamber 74 of cylinder 38 are connected to a low pressure reservoir of the inlet side of the hydraulic pump 66.

2. By changing the valve position, pressure can be applied to the near chamber 71 of cylinder 38 and to the far chamber 74 of cylinder 38 while the far chamber 70 of cylinder 38 and the near chamber 73 of cylinder 36 are connected to a low pressure or to the inlet side of the hydraulic pump 66.

Thus, the two linkages are activated in unison, so that one is shortened as the other is lengthened, creating a uniform swiveling of the sled relative to the towing connector.

In operation, the far upper end of the dredge tow line 9 is connected to a surface vessel which tows the dredge vehicle 8 along the ocean surface, which can be 12,000 to 20,000 feet below the surface of the ocean. The dredge vehicle can be steered by remotely activating, as by electrical impulse, the hydraulic servo motor 66 and the fluid pressure valve connections so as, in the first instance, to apply pressure to the near chamber of cylinder 38, i.e. between the piston 39 and the hinged end 61, and, if desired, to the far chamber of the second cylinder 36, i.e. the portion of the cylinder 36 closest to the connector 42. This causes movement of the first piston 39 towards the hinge 61, referring to the view of FIG. 6, while permitting the second piston 37 to move away from the joint 60. Where the connector 42 is flexible and incapable of resisting axial compressive stress, pressure need not be applied to the opposite side of the second piston 37. This causes the dredge vehicle 8 to pivot relative to the tow pipe 9, causing the bending of the flexible pipe 40, so as to assume the relative position "B" indicated by the phantom lines in FIG. 6. The dredge vehicle 8 can then move towards the right, in the view of FIG. 1, e.g. to steer around an obstacle.

When the desired change of direction has been obtained, the fluid pressure valves can be remotely activated to reverse the application of pressure in each cylinder. That is, pressure is applied to the near chamber of the second cylinder 36, i.e. between the piston 37 and the hinged end 60, and to the far chamber of the first cylinder 38. The dredge vehicle 8 can thus be pivoted back towards the position indicated by the solid lines in FIG. 6. By continuing the movement of the two pistons in this second direction, again referring to FIG. 6, the dredge vehicle 8 can be moved to the attitude, or position, indicated as "A " by the phantom lines in FIG. 6, thus permitting the vehicle to be steered towards the left, referring to FIG. 1, again without changing the direction of motion of the surface ship pulling upon tow line 9.

In the preferred embodiments shown, the towing pipe line 9, 40, 58, 1, also serves as a means for carrying the dredged ore from the dredge vehicle up to the surface vessel, for example, by means of an airlift system such as is described in U.S. Pat. No. 3,522,670. The dredge vehicle can be of any type, including the suction type of dredge, for example, as disclosed in U.S. Pat. No. 3,522,670, a mechanical type dredge vehicle or other system. As explained above, although the sled or runner type of vehicle is most easily adaptable to the present steering system, any other type of system including a wheeled vehicle or a lug tread vehicle can be utilized.

The universal joint 12 in the embodiment of FIGS. 1–5 and the flexible pipe 40 of the embodiment of FIGS. 6 and 7, are substantial equivalents to each other or can, in turn, be replaced by any other type of system, including a double pin system providing for pivotal motion about two transverse, most preferably perpendicular, axes. Similarly, the telescopic joints 10 and 50, respectively, can be substituted by, for example, a bellows type of system or other elastic means which will permit the relative longitudinal movement between the dredge vehicle 8 and the main tow line 9 during the pivotal movement supplied by the steering linkages 14, 15 or 34, 35.

The steering linkages 34 and 35 can be varied in their placement from the configuration shown in FIGS. 6 and 7. For example, the location of the piston rods 37, 39 and the cylinder ends 36, 38 can be reversed. Similarly, the flexible cables 42 can be replaced by relatively rigid tie rods, or arms, containing the necessary elbow linkages, having the requisite pivotal movement about at least two transverse, and preferably perpendicular, axes.

The pivotable joints 60, 61, are shown as being pivotable about two perpendicular axes, so as to achieve a "universal joint". This particular joint can be replaced by, for example, a ball-joint or a ring-and shackle-joint, in order to retain the desired two axes of rotation, or even by a single pin hinge, where a "universal joint" is not necessary. The type of "universal" hinge having two transverse pins, as shown, has the advantage for this high-load application where dependability is critical, and where rotation about a third transverse axis, i.e., about the axis of the hydraulic cylinders, is not required. A similar type of "universal joint" connector can also be utilized at the tow-line end of the piston rods 37, 39, when tie rods are used in place of the cables 42.

The hydraulic servo motor 16, can be operated directly by electric current or other means. The control valves can also be operated from the surface by electric servomechanisms of generally conventional construction, but sealed carefully from entry of sea water.

The embodiments defined above and depicted in the drawings are merely those which are preferred in accordance with the present knowledge of the inventors, but are not intended to define the full scope of the present invention. The scope of the invention is defined solely by the claims set forth below.

The patentable embodiments of this invention which are claimed are:

1. A dredging system designed and adapted to be towed along the ocean floor via a surface vessel connected thereto by a tow line, the dredge system comprising:

(a) a dredge vehicle;

(b) lower tow connector means secured to the dredge vehicle;

(c) positioning means for pivotally and telescopically securing the lower tow connector to the tow line including a tow-line coupling;

(d) a first and a second hydraulically actuated, telescopically movable steering linkage means extending between the tow-line coupling and opposing first and second sides of the dredge vehicle; and (e) means for alternately hydraulically activating the first and second steering linkages, whereby the dredge vehicle can be pivoted relative to the tow line by hydraulically pushing on the first steering linkage, so as to shorten the first linkage and thus pulling the first side of the dredge vehicle towards the coupling and can be pivoted in an opposite direction relative to the tow line by hydraulically pushing on the second steering linkage so as to shorten the second linkage and thus pulling the second side of the dredge vehicle towards the coupling.

2. The steerable dredge system of claim 1 wherein the steering linkages each comprise a hydraulic piston and cylinder, the piston slidably held within the cylinder, one of each piston and cylinder being pivotally connected to the coupling and the second being pivotally connected to the side of the dredge, and means for alternately applying pressure to opposing sides of each piston within each cylinder.

3. The steerable dredge system of claim 2 wherein the far end of each piston is connected to the coupling and each cylinder is connected to the side of the dredge.

4. The steerable dredge system of claim 3 wherein the lower tow connector means is connected to the tow means via a flexible pipe and a biased telescopic joint.

5. The steerable dredge system of claim 4 wherein the telescopic joint is spring biased to an intermediate position.

6. The steerable dredge system of claim 2 comprising a flexible connector between each piston and cylinder and one of the coupling and the side of the dredge.

7. The steerable dredge system of claim 6 comprising a hinged joint between each piston and cylinder and the other of the coupling and the side of the dredge, each hinged joint being pivotable about two transverse axes.

8. A remotely steerable towed dredge system comprising:

a dredge vehicle having runners designed and adapted to support the vehicle on the ocean floor;

a lower substantially rigid tow connector secured to the dredge vehicle;

a substantially rigid tow line portion;

an upper tow connector coupled to the tow line portion and to the lower tow connector, the upper tow connector comprising, in line, a biased telescopic joint and a flexible pipe, the telescopic joint being capable of reciprocal longitudinal movement along the axis of the tow line;

first and second hydraulically actuated piston and cylinder pairs flexible secured to the tow line portion and pivotally secured to opposing sides of the dredge vehicle;

hydraulic pump means secured to the dredge vehicle and operatively connected to the first and second hydraulic cylinders;

remotely controlled valve means in fluid flow connection between the hydraulic pump and the hydraulic cylinders for alternately connecting opposing sides of each hydraulic piston to the pressure side of the pump;

whereby exposing a first side of the first piston to the pressure from the pump causes the dredge vehicle to pivot relative to the tow line in a first direction, and exposing pressure from the hydraulic pump to the first side of the second hydraulic piston, while removing the pressure from the first side of the first piston, causes the dredge vehicle to pivot in a second opposing direction relative to the tow line.

9. The steerable dredge system of claim 8 comprising a hinged joint pivotally connecting each piston and cylinder pair to the side of the dredge vehicle, each hinged joint being pivotable about two transverse axes.

10. A dredging system designed and adapted to be towed along the ocean floor via a surface vessel connected thereto by a tow line, the dredge system comprising:

(a) a dredge vehicle;

(b) lower tow connector means secured to the dredge vehicle;

(c) positioning means for pivotally and telescopically securing the lower tow connector to the tow line including a tow-line coupling;

(d) a first and a second longitudinally reciprocally movable steering linkage means extending between the tow-line coupling and opposing first and second sides of the dredge vehicle; and (e) means for simultaneously but oppositely shortening and lengthening the first and second steering linkages, whereby the dredge vehicle can be skewed in a first direction relative to the tow line by shortening the first steering linkage, while simultaneously lengthening the second linkage, and thus pulling the first side of the dredge vehicle towards the coupling, and can be skewed in the opposite direction relative to the tow line by shortening the second steering linkage while simultaneously lengthening the first linkage, and thus pulling the second side of the dredge vehicle towards the coupling.

* * * * *

UNITED STATES PATENT AND TRADEMARK OFFICE

CERTIFICATE OF CORRECTION

PATENT NO. : 4,249,324

DATED : February 10, 1981

INVENTOR(S) : John P. Latimer

It is certified that error appears in the above-identified patent and that said Letters Patent are hereby corrected as shown below:

Title Page, column 1 "[*] Notice:", line 2 of this section should read --subsequent to June 24, 1997,--

Signed and Sealed this

*Twenty-ninth* Day of *September 1981*

[SEAL]

*Attest:*

GERALD J. MOSSINGHOFF

*Attesting Officer*

*Commissioner of Patents and Trademarks*